United States Patent [19]

Baumgärtner

[11] 4,164,127

[45] Aug. 14, 1979

[54] PROCESS AND DEVICE FOR ROOM COOLING

[75] Inventor: Klaus Baumgärtner, Düsseldorf-Wittlaer, Fed. Rep. of Germany

[73] Assignee: Messer Griesheim GmbH, Frankfurt am Main, Fed. Rep. of Germany

[21] Appl. No.: 802,717

[22] Filed: Jun. 2, 1977

[30] Foreign Application Priority Data

Jun. 14, 1976 [DE] Fed. Rep. of Germany ..... 2626644

[51] Int. Cl.[2] ..... F25D 17/02; F25B 27/02; F25B 19/00

[52] U.S. Cl. ..... 62/98; 62/238; 62/514 R

[58] Field of Search ..... 62/98, 514, 121, 118, 62/122, 238

[56] References Cited

U.S. PATENT DOCUMENTS

| | | | |
|---|---|---|---|
| 2,964,917 | 12/1960 | Webster | 62/514 R |
| 3,257,818 | 6/1966 | Papapanu | 62/98 |
| 3,258,933 | 7/1966 | Osborne | 62/98 |
| 3,672,182 | 6/1972 | Stowasser et al. | 62/98 |
| 3,986,664 | 10/1976 | Gustafsson | 62/238 |
| 3,989,183 | 11/1976 | Gustafsson | 62/238 |
| 3,994,141 | 11/1976 | Schrawer | 62/514 R |

*Primary Examiner*—Lloyd L. King
*Attorney, Agent, or Firm*—Connolly and Hutz

[57] ABSTRACT

Rooms are cooled by water circulating radiators of a heating installation by utilizing liquid nitrogen to cool the water flowing through the radiators or by circulating cold gaseous nitrogen through the radiators after draining the water.

4 Claims, 3 Drawing Figures

PROCESS AND DEVICE FOR ROOM COOLING

BACKGROUND OF THE INVENTION

The invention is concerned with a process for room cooling using the water radiators of a heating installation, especially for cooling work and for waiting rooms on extremely hot summer days.

In zones with moderate climate, there are only few days in the year with extremely high temperatures. It does not pay, therefore, as a rule to equip dwellings, work areas and waiting rooms with presently known cooling devices since such devices are very expensive.

SUMMARY OF THE INVENTION

An object of the invention is to make possible air conditioning on extremely hot summer days with small investment cost and affordable operating costs.

Now, a process for air conditioning using the water radiators of a heating installation has been found, by which, according to the invention, water flowing through the radiators is cooled by liquid nitrogen, or, after blowing off the water, cold gaseous nitrogen circulates through the radiators.

The cooling of the water can occur in two different ways, usually by direct or indirect heat exchange. In the case of direct heat exchange, the liquid nitrogen is injected in finely distributed form in the water circuit and subsequently drawn off again into a trap. The bore of the nozzles must hereby be so selected, depending on the amount of liquid nitrogen to be injected so that clogging due to ice formation is prevented. With indirect heat exchange, the water is cooled in a heat exchange, preferably a plate heat exchanger, by evaporating liquid nitrogen. An ice buildup on the plates can hereby be tolerated.

According to a variation of the invention, the water is not cooled but rather drained out of the heating system in that it is either removed entirely from the installation or stored in a container or tank. Cold gaseous nitrogen, obtained by evaporating liquid nitrogen circulates in the radiators and is conducted into the atmosphere.

The invention assumes that the rooms to be cooled are hooked up to a central heating system, which as a rule, is the case. The additional investments are small compared to the cost of the heating system. Either a device for injecting the liquid nitrogen with a gas trap coupled to it must be built into the water circuit or else a heat exchanger which is acted upon by the water circuit and by the liquid nitrogen. In the case of direct cooling with gaseous nitrogen, practically no additional components at all need to be built in.

In any case, a simple regulating arrangement for the water temperature or the supply of nitrogen must be provided. The liquid nitrogen can be supplied in insulated rental containers.

With the invention's practice the circulating water can be cooled to any temperature below room temperature at the maximum (cooling) down to a small amount above the freezing point. By using liquid circulating media other than water, even lower temperatures can be achieved. However, the simplicity of the invention's process is lost here.

THE DRAWINGS

FIG. 1 schematically shows an installation for injecting liquid nitrogen into the water circuit in accordance with one practice of the invention;

FIG. 2 shows schematically an installation with indirect heat exchange in accordance with another practice of the invention; and FIG. 3 schematically illustrates the arrangement of FIG. 1 with a room shown in phantom.

DETAILED DESCRIPTION

Figure 1:
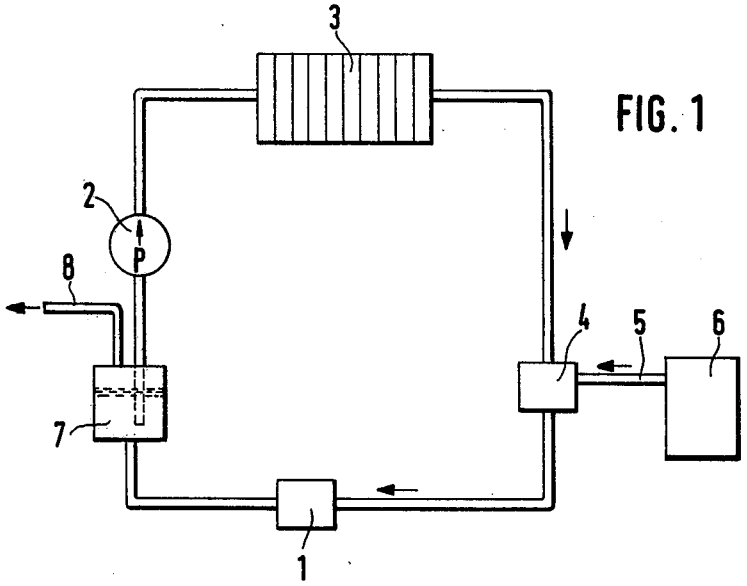

The central heating system according to the illustrated example in FIG. 1 consists of the boiler tank 1 shut off by the cooling operation, the circulating pump 2 and the radiator 3. According to the invention, a mixing device 4 in which liquid nitrogen is injected into the circulating water is connected to the water circuit. The liquid nitrogen reaches the mixing device 4 via an insulated line 5 from an insulated vessel 6. To the mixing device 4 a gas trap 7 is connected in which the injected nitrogen is drawn off in the gaseous state and removed via line 8.

Figure 2:
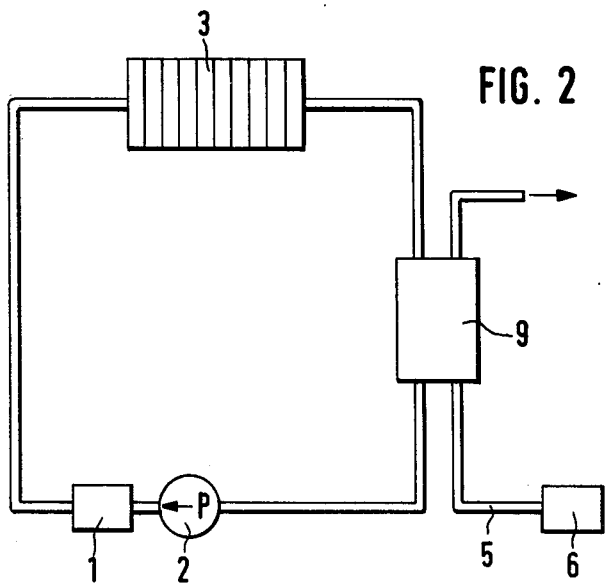
Figure 3:
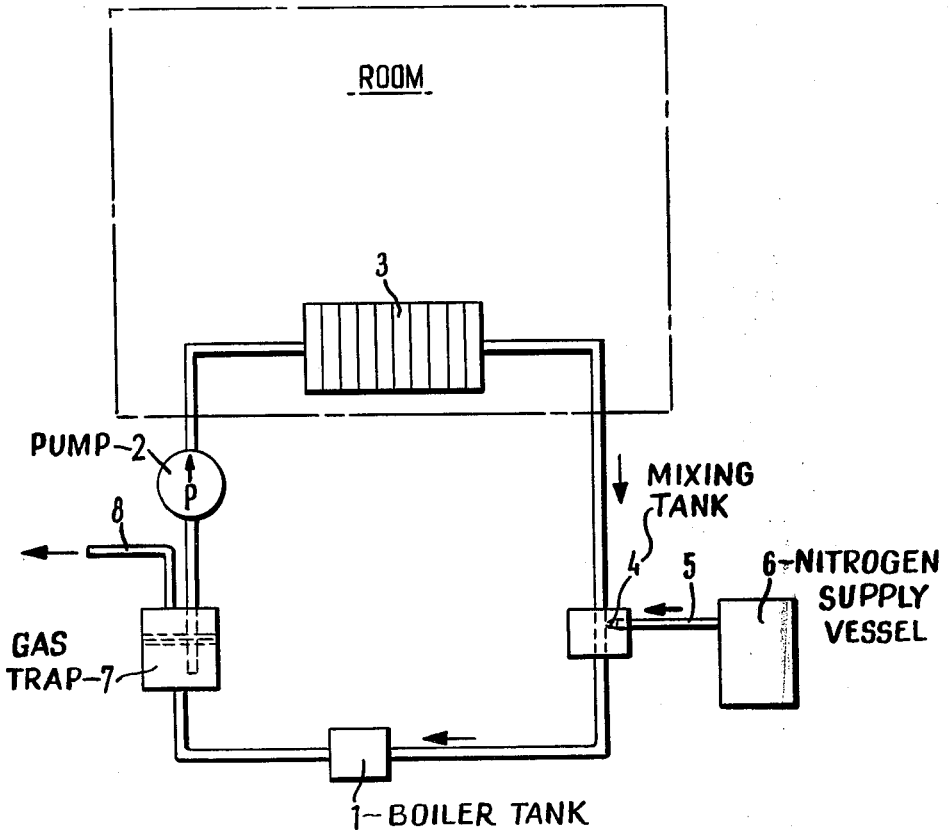

The installation according to FIG. 2 consists again of the tank 1, the circulating pump 2 and the radiator 3. Into the water circuit, according to the invention, is connected a plate heat exchanger 9 in which liquid nitrogen evaporates in the reverse direction. The liquid nitrogen is again supplied to the plate heat exchanger 9 from an insulated vessel 6 via an insulated line 5. The regulation of the temperature of the circulating water and of the liquid nitrogen quantity is not illustrated in either example.

What is claimed is:

1. In a process for periodically cooling a room and the like having a radiator therein as part of a central heating system which supplies water to the radiator through a water circuit in the form of a continuous loop which flow communicates with the radiator, the improvement being injecting liquid nitrogen into a mixing device in flow communication with the water circuit, utilizing the injection of liquid nitrogen in the water circuit to lower the temperature of the water to a temperature at least slightly above its freezing point, and discharging the gaseous form of the nitrogen from the water circuit through a gas trap which is downstream from the mixing device and which communicates with the water circuit.

2. In a process for periodically cooling a room and the like having a radiator therein as part of a central heating system which supplies water to the radiator through a water circuit in the form a continuous loop which flow communicates with the radiator, the improvement being providing a heat exchanger through which the water circuit passes, injecting liquid nitrogen through a flow line which is exposed to the atmosphere for venting nitrogen therefrom, and passing the nitrogen flow line through the heat exchanger to lower the temperature of the water in the water circuit to a temperature at least slightly above its freezing point.

3. In a device for periodically cooling a room and the like characterized by a central heating system having a radiator in the room supplied by water flowing through a water circuit, the improvement being said water circuit being in the form of a continuous loop with which said radiator is in flow communication, a source of liquid nitrogen, a mixing device in flow communication with said water circuit, a flow line leading from said liquid nitrogen source to said mixing device for injecting liquid nitrogen into said water circuit for lowering the temperature of the water flowing therethrough, a gas trap in said water circuit downstream from said mixing device, and an exhaust line leading from said gas trap for discharging the gaseous form of nitrogen flowing through said water circuit.

4. In a device for periodically cooling a room and the like characterized by a central heating system having a radiator in the room supplied by water flowing through a water circuit, the improvement being said water circuit being in the form of a continuous loop with which said radiator is in flow communication, a source of liquid nitrogen, a flow line leading from said liquid nitrogen source and exposed to the atmosphere for venting nitrogen therefrom, a heat exchanger, and said water circuit and flow line passing through said heat exchanger whereby said nitrogen cools the water flowing through said water circuit.

* * * * *